US005356099A

United States Patent [19]

Sereboff

[11] Patent Number: 5,356,099

[45] Date of Patent: Oct. 18, 1994

[54] WRIST SUPPORT SYSTEM

[76] Inventor: Joel L. Sereboff, 2215 Millridge Rd., Owings Mills, Md. 21117

[21] Appl. No.: 82,498

[22] Filed: Jun. 28, 1993

[51] Int. Cl.[5] ..... B43L 15/00

[52] U.S. Cl. ..... 248/118.1; 248/918; 400/715

[58] Field of Search ..... 248/118, 118.1, 118.3, 248/118.5, 918; 297/411, 416; 400/715; 5/644

[56] References Cited

U.S. PATENT DOCUMENTS

| | | | |
|---|---|---|---|
| 4,220,309 | 9/1980 | Eisen | 248/542 |
| 4,545,554 | 10/1985 | Latino | 248/118.1 |
| 4,688,862 | 8/1987 | Fowler | 248/118.5 X |
| 4,896,388 | 1/1990 | Bard | 5/644 |
| 5,050,826 | 9/1991 | Johnson | 400/715 X |
| 5,125,606 | 6/1992 | Cassano | 400/715 X |
| 5,148,256 | 10/1992 | Gross | 248/118.3 |
| 5,158,255 | 10/1992 | Fuller | 248/118 |
| 5,170,971 | 12/1992 | Schaeffer | 248/118.1 |
| 5,173,979 | 12/1992 | Nennhaus | 5/644 X |
| 5,183,230 | 2/1993 | Walker | 248/118.3 X |
| 5,219,136 | 6/1993 | Hassel | 248/918 |
| 5,228,655 | 7/1993 | Garcia | 400/715 X |
| 5,234,186 | 8/1993 | Powell | 400/715 X |

*Primary Examiner*—J. Franklin Foss
*Attorney, Agent, or Firm*—Morton J. Rosenberg; David I. Klein

[57] ABSTRACT

This invention provides for a wrist support system (10) which is generally positioned adjacent a keyboard (12) of a computer system (14) or typewriter which is directed to alleviating the symptoms of carpal tunnel syndrome. The wrist support system includes a support member (22) which is mounted on a base surface (28) adjacent the keyboard (12). A liquid containing pack (30) is mounted on an upper surface (32) of the support member (22) for resiliently interfacing with a user's palm area (20) and wrist area (18) when the user is operating the keyboard (12). The liquid containing pack (30) is deformable to the contours of the palm area (20) and wrist area (18) and provides a flexible support for the user's interfacing areas.

20 Claims, 2 Drawing Sheets

WRIST SUPPORT SYSTEM

BACKGROUND OF THE INVENTION

1. Field of the Invention

This invention relates to wrist support systems for alleviating the symptoms of carpal tunnel syndrome of typists or computer operators spending extensive periods of time operating keyboards. In particular, this invention pertains to a wrist support system which allows the user to rest his or her palm and wrist on a deformable and flexible liquid containing or gel pack. Still further, this invention pertains to a wrist support system which includes flexible and deformable members which deform to the contour of a particular user's palm and wrist and further disperses the load applied over a wider area to minimize the stress associated with the force loading of person's appendage. More in particular, this invention directs itself to a wrist support system which includes a support member which is mounted adjacent a keyboard having a liquid containing pack located on an upper surface of the support member for resiliently interfacing with the user's palm and wrist areas when the user is operating the keyboard. Still further, this invention directs itself to a wrist support system where the deformable and resilient portion of the system is adjustable in either the longitudinal or transverse direction when taken with respect to a support member. Further, this invention directs itself to an adjustably displaceable liquid or gel pack which may be displaceably adjusted on a support member in a predetermined direction dependent upon the particular physiology of a user.

2. Prior Art

Deformable liquid or gel containing packs are known in the art. The best prior art known to the Applicant includes U.S. Pat. Nos. 134,116; 4,378,009; 4,481,556; 4,482,063; 4,482,064; 4,545,554; 4,621,781; 4,753,241; 4,938,207; 4,964,402; 4,972,832; 4,973,176; 5,034,998; 5,050,596; 5,065,758; 5,088,478; 5,129,391; 5,131,614; 5,150,707; 5,159,717; and, 5,173,963.

Prior art systems such as U.S. Pat. No. 5,129,391 are directed to thermal packs which include an elongated member having a pocket which contains a gel. Such packs may be secured to the human body through tabs and fasteners to allow securement of the thermal pack around a body portion. However, such prior art systems do not provide for interface with the wrist of a user mounting such on a support member as is necessary to the subject invention concept.

Other prior art systems such as that shown in U.S. Pat. No. 4,753,241, are directed to the of methods of forming and using therapeutic devices which include chambers adapted to be filled with some type of thermally responsive medium. Such therapeutic devices are provided for covering various parts of the human body however, such are not directed to a deformable system for interfacing with a user's palm and wrist area to alleviate carpal tunnel syndrome as is necessary to the subject invention concept.

In other prior art systems such as that shown in U S. Pat. No. 4,964,402, there are provided orthopedic devices which include wrist/forearm braces or pad members having gel pads secured internal to the pad member for increasing the support and cushioning effect for the wrist and forearm of the user. However, such do not provide for the combined structure of the subject invention concept wrist support system which includes an adjustably positioned gel or liquid containing pack mounted on a support system for positional location adjacent a keyboard in the environment of the subject invention concept.

SUMMARY OF THE INVENTION

A wrist support system is provided which is positionally located adjacent a keyboard for alleviating symptoms of carpal tunnel syndrome. The wrist support system includes a substantially planar and longitudinally extending support member mounted on a base surface adjacent the keyboard. Additionally, a liquid containing pack is positionally located contiguous to an upper surface of the support member for resiliently interfacing in a deformable manner with at least a portion of a user's palm and wrist when the user is operating the keyboard.

An object of the present invention is to relieve symptoms of carpal tunnel syndrome found by users who spend extended periods of time operating a keyboard associated with a computer system or a typewriter type mechanism.

A further object of the subject invention is to provide a wrist support system which reduces irritation and swelling of tendons in a user's hand to obviate compression of the median nerve of a user during operation of a keyboard system.

Still further, an object of the subject invention system is to provide a wrist support system wherein a liquid containing pack is adjustably mounted on a support member in order to allow positional adjustability of the liquid or gel pack responsive to a particular physiology of the user.

A still further object of the subject wrist support system is to provide a releasably secured liquid containing or gel pack which deforms and is flexible responsive to interface with a user's palm or wrist area when the user rests his or her appendage thereon.

Another object of the wrist support system is to disperse the load forces applied by a user's arm under gravity loading to reduce the stress applied thereto.

A further object of the wrist support system is to provide a releasably secured liquid containing or gel pack captured within a pocket formed in a covering member.

Another object of the wrist support system is to provide a base surface either on the liquid containing pack or a covering member which supports indicia formed thereon for the purpose of providing advertising or other useful data.

DESCRIPTION OF THE PREFERRED EMBODIMENTS

Figure 1:
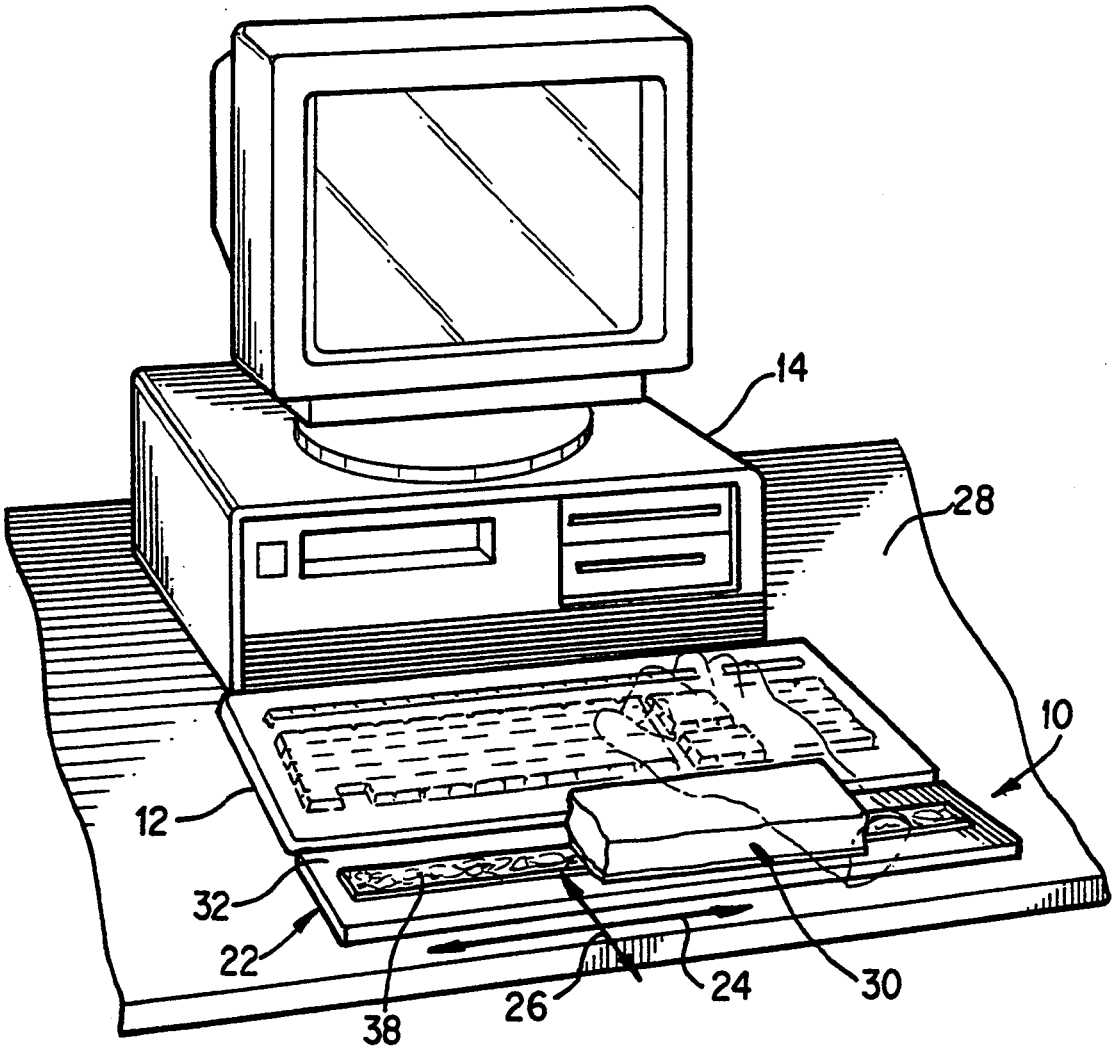
FIG. 1 is a perspective view of the wrist support system adjacent a keyboard and computer system with the wrist support system partially cut-away.
Figure 2:
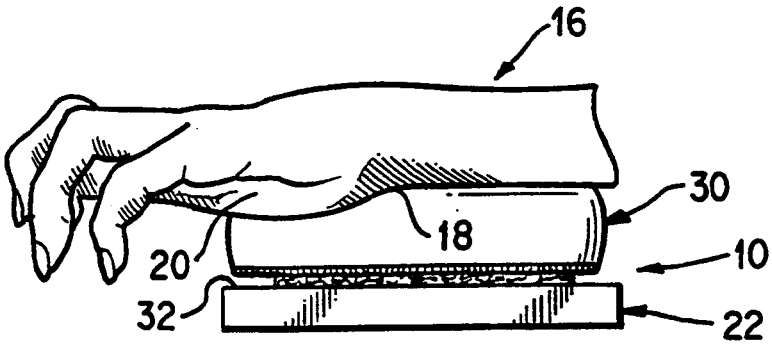
FIG. 2 is an elevational view of the deformable interface between the wrist support system and a user's appendage.
Figure 3:
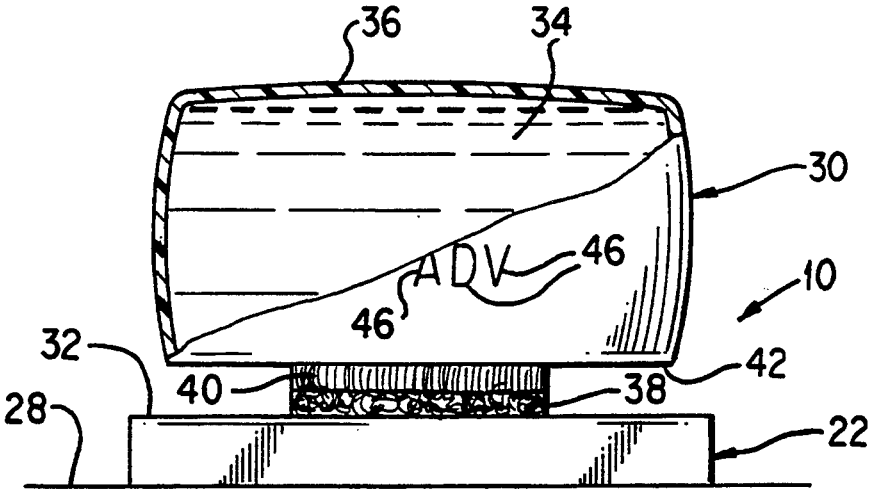
FIG. 3 s a partially cut-away view of the wrist support system of the subject invention concept showing a liquid filled pack.

Referring now to FIGS. 1–3, there is shown wrist support system 10 being positionally located adjacent keyboard 12 which may be used in conjunction with standard computer system 14. Wrist support system 10 is specifically directed to alleviation of the symptoms of carpal tunnel syndrome which has become an increasing problem in recent history. Persons who have spent an extended time before typewriters or computer systems 14 and have operated keyboards 12 associated therewith have been prone to acquiring carpal tunnel syndrome. In general the carpal tunnel is located on the palm side of a person's wrist and is formed by a carpal ligament and several wrist or carpal bones. There are nine tendons and the median nerve passing therethrough. The median nerve provides displacement and sensation to the middle finger, the index finger and the thumb of the user as well as portions of the ring finger. It has been found that for prolonged periods of use of keyboards 12, the tendons and/or their coverings may become irritated and swell. If one of the tendons in the carpal tunnel swells such may press on the median nerve and the person may lose control or sensation in their thumb and fingers.

The overall concept of wrist support system 10 is to provide the user with a flexible, resilient and deformable support for the user's wrist and palm areas during operation of the keys on keyboard 12. Wrist support system 10 thus reduces the compression loading of the median nerve from either internal or external sources through interface of the user's appendage 16 with wrist support system 10. In particular, as will be further described in following paragraphs, and as is shown in FIG. 2, the user's appendage 16 contiguously interfaces with wrist support system 10 in both wrist area 18 as well as palm area 20.

Wrist support system 10 includes substantially planar support member 22 which extends in longitudinal direction 24 and is mounted on base surface 28 adjacent keyboard 12. Support member 22 may be displaced in either transverse direction 26 and/or longitudinal direction 24 at the discretion of the user for maximum comfort in a positional relationship with keyboard 12.

Support member 22 may be formed of a relatively hardened composition such as plastic, wood, or metal or further in the alternative may be formed of a somewhat less rigid material such as open called plastic composition however, such is not important to the inventive concept with the exception that such has sufficient structural integrity to accept the load applied by appendage 16 of the user or operator. As shown, support member 22 may be generally rectangular in cross-section and includes a dimension in longitudinal direction 24 generally, but not necessarily substantially equal to the longitudinal extension of keyboard 12.

Wrist support system 10 further includes liquid containing pack 30 which is seen in FIGS. 1–3 to be positionally located contiguous support member upper surface 32 for resiliently interfacing in a deformable manner with palm 20 and wrist area 18 when the user is operating the keys on keyboard 12. As seen in FIG. 3, pack 30 includes a substantially liquid type composition 34 which may be in the form of a liquid having a viscosity approximating the viscosity of water or may include a gel composition contained therein having a viscosity substantially above that of water. The important concept is that liquid containing pack 30 be resilient in contour and deformable when appendage 16 is applied thereto. Pack 30 includes pack covering 36 which encloses liquid composition 34 therein. Pack covering 36 is formed of a material which is impervious to liquid transport therethrough and may be formed of a closed cell deformable plastic such as polyethylene or some like composition not important to the inventive concept as herein described with the exception that pack covering 36 completely enclose liquid composition 34 and that such is formed of a composition which does not allow transport of liquid therethrough. Additionally, liquid composition 34 may completely fill the interior of liquid containing pack 30 or alternatively may only fill a portion of the interior volume.

It is to be understood that pack covering 38 may be secured through adhesive bonding or some like technique to a soft fabric for interfacing comfortably with a user's skin.

Liquid or gel pack 30 is coupled to support member upper surface 32 in fixed relation thereto as is seen in FIGS. 1–3. Coupling may be through fixed securement such as adhesive bonding between pack 30 and support member 22 or in the alternative may include a releasable coupling mechanism for releasably securing pack 30 to upper surface 32 of support member 22.

Figure 5:
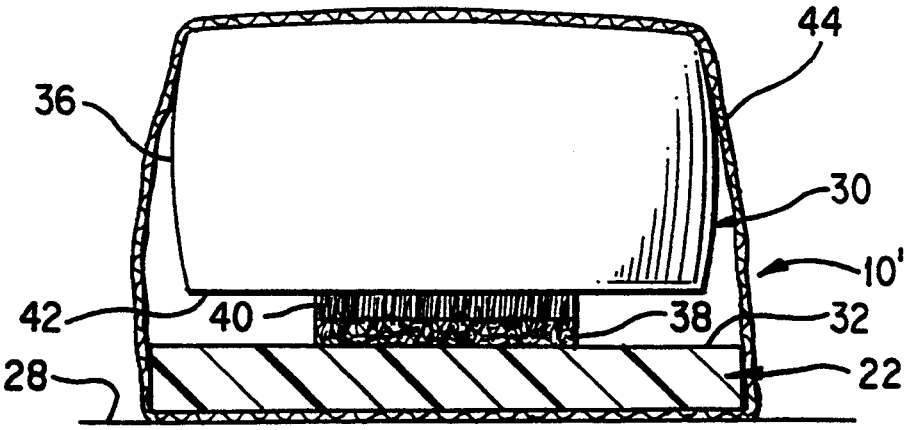

A mechanism for releasably securing liquid containing pack 30 to support member 22 includes first releasable securement strip member 38 fixedly coupled to upper surface 32 of support member 22. First releasable securement strip member 38 may extend substantially throughout the longitudinal dimension of support member 22 as is seen in FIG. 1. First releasable securement strip member 38 may be fixedly secured to upper surface 32 through adhesive bonding or some like securement method. Additionally, the mechanism for releasably securing pack 30 includes second releasable securement strip member 40 which is fixedly coupled to lower surface 42 of liquid containing pack 30 as is seen in FIG. 3. As was the case for first releasable securement strip member 38, second releasable securement strip member 40 may be secured through adhesive bonding or some like fixed securement mechanism. Both first and second releasable securement members 38 and 40 may include hook and loop elements for mutual engagement thereof as is seen in FIGS. 2, 3 and 5. In particular, first and second releasable securement members 38 and 40 may preferably form a Velcro releasable attachment therebetween as is known.

In this manner, liquid or gel pack 30 may be positionally located for maximum comfort of the user in both longitudinal direction 24 as well as transverse direction 26 when taken with relation to the keys on keyboard 12. As is clear, releasable securement and displacement in transverse direction 26 allows the user to maximize the comfort for appendage 16 based on the particular physiology of the user. As is clear, wrist support system 10 is directed to a universal system which allows different physiologies of users to come into effect. Appendages 16 vary quite a bit between different users and thus positioning of gel pack 30 may be of significant importance to the comfort of the user during operation of the keys on keyboard 12.

Additionally, the longitudinal extension of liquid containing or gel pack 30 may vary over wide range of dimensions. In fact, pack 30 may extend throughout the extension length of support member 22 in longitudinal direction 24 or alternatively may have a lesser dimension for easing the positional adjustment capabilities of pack 30 on support member 22.

Figure 4:
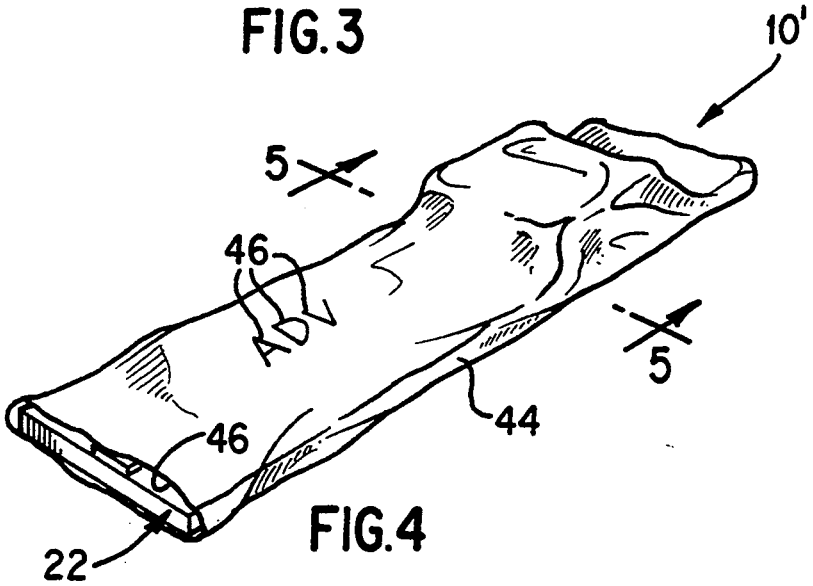
FIG. 4 is a perspective view of an embodiment of the wrist support system showing a covering for a support member and an enclosed pack; and, FIG. 5 is a cross-sectional view of the embodiment shown in FIG. 4 taken along the section line 5—5 of FIG. 4

Referring now to FIGS. 4 and 5, there is seen wrist support system 10' which is an embodiment of wrist support system 10 described in FIGS. 1–3. With reference to wrist support system 10', as is seen in FIG. 5 gel pack 30 is secured to support member 22 through first and second releasable securement strip members 38 and 40. However, wrist support system 10' includes flexible covering 44 which encloses both pack 30 and support member as shown. In this manner, gel or liquid pack 30 in combination with support member 22 may be inserted internal flexible covering 44 to maintain the overall combination as a unitary assembly. Additionally, flexible covering 44 may be formed of some type of textile material which allows for insert into a pocket formed therein. Flexible covering 44 may include opening 46 formed on one end thereof as is shown in FIG. 4 for ease of insert and removal of the combination pack 30 and support member 22.

Flexible covering 44 may additionally contain indicia 46 formed thereon for advertising or instructional purposes. Indicia 46 may be formed alternatively directly on an outer surface of liquid containing pack 30 for the aforementioned purposes.

In the manner previously described there is provided wrist support system 10 or 10' which is mounted adjacent keyboard 12 of computer system 14, a typewriter or some like mechanism which is resilient and deformable upon interface with appendage 16 of a user. In particular, wrist support system allows for contiguous interface with at least a portion of the palm area 20 as well as wrist area 18 of the user to relieve any symptoms associated with carpal tunnel syndrome.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A wrist support system positionally located adjacent a keyboard for alleviating symptoms of carpal tunnel syndrome, comprising:

(a) a substantially planar and longitudinally extending support member mounted on a base surface adjacent said keyboard; and, (b) a liquid containing pack positionally located contiguous an upper surface of said support member continuously and substantially conforming to at least a portion of a user's palm and wrist when said user is operating said keyboard for resiliently supporting said user's palm and wrist, said liquid substantially filling an interior volume of said liquid containing pack.

2. The wrist support system as recited in claim 1 where said liquid containing pack includes a contained liquid having a viscosity approximating the viscosity of water.

3. The wrist support system as recited in claim 1 where said liquid containing pack includes a gel composition contained therein.

4. The wrist support system as recited in claim 1 where said liquid containing pack is fixedly coupled to said upper surface of said support member.

5. The wrist support system as recited in claim 4 where said liquid containing pack is adhesively coupled to said upper surface of said support member.

6. The wrist support system as recited in claim 1 including means for releasably securing said liquid containing pack to said upper surface of said support member.

7. The wrist support system as recited in claim 6 where said means for releasably securing said liquid containing pack includes:

(a) at least a first releasable securement strip member fixedly attached to said upper surface of said support member, said first releasable securement strip member substantially extending a longitudinal dimension of said upper surface of said support member; and, (b) at least a second releasable securement strip member fixedly attached to a lower surface of said liquid containing pack.

8. The wrist support system as recited in claim 7 where said first and second releasable securement members comprise hook and loop elements for mutual engagement thereof.

9. The wrist support system as recited in claim 8 where said first and second releasable securement members form a Velcro releasable attachment therebetween.

10. The wrist support system as recited in claim 1 where said liquid containing pack includes an extended longitudinal dimension substantially equal to a longitudinal extension dimension of said support member.

11. The wrist support system as recited in claim 1 where said liquid containing pack is adjustably positionable in secured relation to said upper surface of said support member.

12. The wrist support system as recited in claim 11 where said liquid containing pack includes a longitudinal dimension substantially less than a longitudinal dimension of said support member.

13. The wrist support system as recited in claim 1 including flexible covering means for substantially encompassing said liquid containing pack and said support member for maintaining said liquid containing pack and said support member as a unitary assembly.

14. The wrist support system as recited in claim 13 where said flexible covering means includes a covering member forming a pocket for insert of said unitary assembly.

15. The wrist support system as recited in claim 14 where said covering member includes an outer surface having indicia formed thereon.

16. The wrist support system as recited in claim 14 where said covering member is formed of a textile material composition.

17. The wrist support system as recited in claim 1 where said support member is formed of a plastic composition.

18. The wrist support system as recited in claim 1 where said liquid containing pack includes indicia formed on an outer surface thereof.

19. The wrist support system as recited in claim 1 where said support member is formed of a metal composition.

20. The wrist support system as recited in claim 1 where said liquid containing pack is a gel pack.

* * * * *